US005299505A

United States Patent [19]

Theurer et al.

[11] Patent Number: 5,299,505

[45] Date of Patent: Apr. 5, 1994

[54] BALLAST TAMPING MACHINE HAVING PIVOTABLE AND EXTENDABLE AUXILIARY LIFTING AND LINING UNIT FOR BRANCH TRACK

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 19,092

[22] Filed: Feb. 18, 1993

[30] Foreign Application Priority Data

Mar. 25, 1992 [AT] Austria ..... 613/92
Nov. 13, 1992 [AT] Austria ..... 2242/92

[51] Int. Cl.[5] ..... E01B 29/04
[52] U.S. Cl. ..... 104/7.2; 104/7.1
[58] Field of Search ..... 104/7.1, 7.2

[56] References Cited

U.S. PATENT DOCUMENTS 4,111,128 9/1978 Keyes ..... 104/7.2
4,248,154 2/1981 Theurer ..... 104/7.2
4,825,768 5/1989 Theurer et al. ..... 104/7.2
4,893,565 1/1990 Theurer et al. ..... 104/7.2
4,905,604 3/1990 Theurer ..... 104/7.2
5,142,988 9/1992 Ganz ..... 104/7.1

FOREIGN PATENT DOCUMENTS 268014 5/1989 Fed. Rep. of Germany ..... 104/7.2

*Primary Examiner*—Robert J. Oberleitner
*Assistant Examiner*—S. Joseph Morano
*Attorney, Agent, or Firm*—Collard & Roe

[57] ABSTRACT

A ballast tamping machine comprises a machine frame supported on undercarriages, a tamping unit vertically adjustably mounted on the machine frame and comprising reciprocable vibratory tamping tools, and a track lifting and lining unit mounted on the machine frame and comprising lifting and lining drives, a flanged roller and a lifting tool. An auxiliary track lifting device is associated with the track lifting and lining unit, the auxiliary track lifting device comprising a carrier frame, a tool for gripping a branch track rail mounted on the carrier frame end, a lifting drive, a displacement drive for adjusting the branch track rail gripping tool on the carrier frame relative to the machine frame, and a part for contacting and resting on the branch track rail mounted adjacent the branch track rail gripping tool.

9 Claims, 2 Drawing Sheets

BALLAST TAMPING MACHINE HAVING PIVOTABLE AND EXTENDABLE AUXILIARY LIFTING AND LINING UNIT FOR BRANCH TRACK

BACKGROUND OF THE INVENTION

1. Field of the Invention

The present invention relates to a ballast tamping machine for leveling, lining and tamping a track switch comprising a main track and a branch track comprising a rail laterally adjacent the main track and having a rail head, which comprises a machine frame extending in a longitudinal direction and supported on undercarriages, a tamping unit vertically adjustably mounted on the machine frame and comprising reciprocable vibratory tamping tools, a track lifting and lining unit mounted on the machine frame and comprising lifting and lining drive means, a flanged roller and a lifting tool, and an auxiliary track lifting device associated with the track lifting and lining unit, the auxiliary track lifting device comprising a carrier frame having an end, a tool for gripping the branch track rail mounted on the carrier frame end, an auxiliary lifting drive means, and a displacement drive for adjusting the branch track rail gripping tool on the carrier frame relative to the machine frame.

2. Description of the Prior Art

U.S. Pat. No. 4,893,565 describes such a mobile track working machine especially designed for operation in track switches and crossings. Work in such track sections is difficult not only because of the complicated rail configuration but particularly because of the very heavy weight of the tracks since the main and branch tracks of these track sections are interconnected by very long ties. This very heavy weight which, in addition, is asymetrically distributed, disadvantageously affects the accuracy of the leveling and lining operation. The machine disclosed in the patent comprises a vertically adjustable tamping head, and a track leveling and lining unit engaging the rails by means of flanged rollers as well as rail clamping hooks and lifting rollers. For operation in track switches, an auxiliary rail lifting device is connected at each side of the machine frame to the track leveling and lining unit, each auxiliary rail lifting device comprising a telescopingly extensible carrier frame operable by a displacement drive and extending transversely to the longitudinal direction of the machine frame. At the outer end of the carrier frame there is provided a rail gripping hook, which is vertically adjustable in a vertical guide for engagement with the branch rail, and a similarly adjustable jack, which serves to support the outer carrier frame end on the ballast in the crib and supplies an additional lifting force by means of its own drive.

U.S. Pat. No. 4,825,768 also discloses a ballast tamping machine whose tamping, track leveling and lining tools are adapted for work in track switches. Its auxiliary rail lifting device comprises a frame mounted for mobility on a rail of the branch track and linked to the machine frame by a connecting rod. The frame carries rail gripping tools and a power-driven cable line connects the frame to a telescopingly extensible cantilevered arm mounted on top of the machine. The drive of the cable line enables the frame and its gripping tools to lift the branch track. The auxiliary rail lifting device may be used on either side of the machine frame by horizontally turning the cantilevered arm and its power-driven cable line by 180°. The engagement and disengagement of the auxiliary lifting device take a relatively long time and cannot be effectuated without the manual assistance by an operator.

SUMMARY OF THE INVENTION

It is the primary object of this invention to provide a ballast tamping machine for leveling, lining and tamping a track switch of the first-described type, in which the auxiliary track lifting device may be readily placed in its operating position from an operator's cab on the machine frame.

In such a ballast tamping machine, the above and other objects are accomplished according to the invention by mounting a part for contacting and resting on the branch track rail adjacent the branch track rail gripping tool.

This arrangement enables a simple handling of the auxiliary track lifting device for lifting a rail of a branch track in a switch since the part contacting and resting on the rail head of the branch rail automatically centers the rail gripping tool for rapidly and securely clamping the branch rail. This dispenses with a special operator for centering and observing the auxiliary lifting device in a track switch, which is full of safety hazzards.

According to one preferred embodiment, the part for contacting and resting on the branch track rail is a roller, particularly a double-flanged wheel, having an axis extending perpendicularly to the longitudinal direction of the machine frame, and the branch track rail gripping tool is a lifting roller comprising a mushroom-shaped element rotatable about an axis for subtending the branch track rail head and a drive for pivoting the lifting roller about an axis extending in the longitudinal direction of the machine frame, the pivoting drive connecting the lifting roller to the carrier frame end adjacent the part for contacting and resting on the branch track rail. This arrangement securely positions the auxiliary track lifting device on the branch rail and securely clamps the branch rail thereto. This assures lifting of the branch rail to the desired level without problems even when the track switch comprises long concrete ties. Furthermore and without requiring repeated centering, tight rail engagement can be maintained over a lengthy track section.

The carrier frame is pivoted to a side of the machine frame remote from the branch rail gripping tool for pivoting about an axis extending in the longitudinal direction of the machine frame, and the auxiliary lifting drive means comprises a lifting drive connecting the carrier frame end opposite the pivoting axis to the machine frame. This provides an advantageous combination of pivoting axis and lifting drive for obtaining a maximum lever effect to transmit the vertical forces without problems to the rail to be lifted.

The carrier frame is preferably tube-shaped and extends in a longitudinal direction, the branch rail gripping tool is mounted in the tube-shaped carrier frame for displacement in the longitudinal direction thereof, and the displacement drive is affixed to the tube-shaped carrier frame and connected to the branch rail gripping tool. The branch rail gripping tool may comprise a gliding part extending into the interior of the tube-shaped carrier frame. This assures that the branch rail gripping tool remains in full and constant engagement with the branch rail during lifting, and that a transverse track displacement may be effected without problems during leveling for simultaneously lining the track.

According to another preferred embodiment, the carrier frame end is arranged between two parallel guide plates extending perpendicularly to the longitudinal direction of the machine frame. This assures the stability of the carrier frame in the longitudinal direction of the machine frame in all pivotal positions so that a stress on the bearing of the axis is avoided.

Finally, it may be desirable to provide two auxiliary track lifting devices, the carrier frames of these devices extending parallel to each other and an end opposite to the carrier frame end of each carrier frame being pivoted to a respective side of the machine frame. In this way, the ballast tamping machine may be used without any further work for operation on tracks branching off the main track either to the right or the left.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
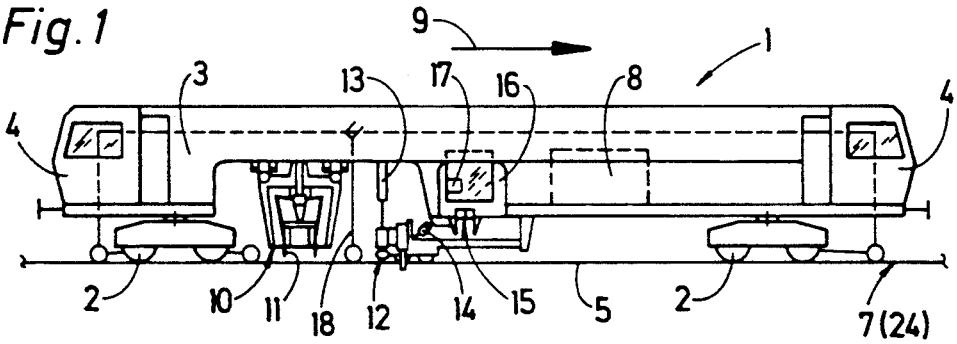
FIG. 1 is a diagrammatic side elevational view of a ballast tamping machine for leveling, lining and tamping a track switch comprising a main track and a branch track comprising a rail laterally adjacent the main track.
Figure 2:
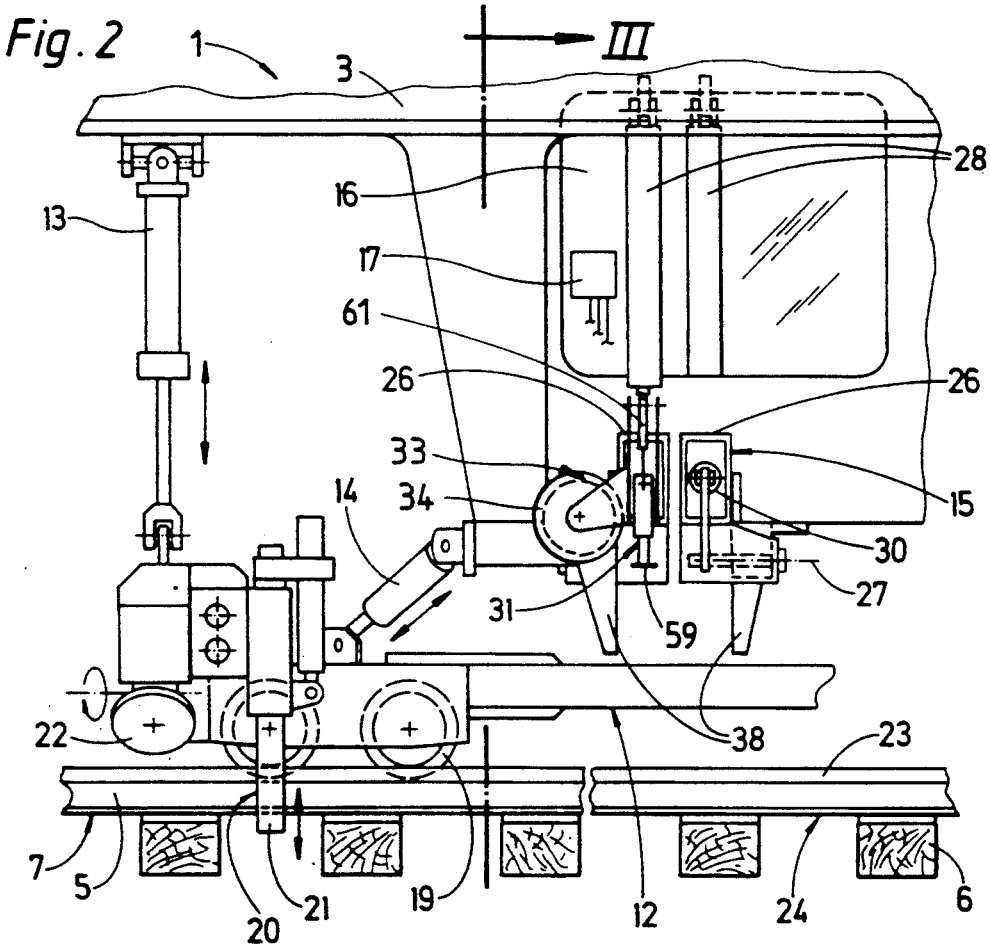
FIG. 2 is an enlarged, fragmentary side elevational view of the machine of FIG. 1, showing the lifting and lining unit with two associated auxiliary track lifting devices.

Referring now to the drawing and first to FIG. 1, there is shown ballast tamping machine 1 for leveling, lining and tamping a track switch comprising a main track and a branch track. Main track 7 is comprised of rails 5 fastened to ties 6 defining cribs therebetween and branch track 24 (see FIGS. 3 and 4) comprises rail 23 laterally adjacent main track 7 and having a rail head. The illustrated track leveling, lining and tamping machine is generally conventional and comprises elongated machine frame 3 extending in a longitudinal direction and supported on undercarriages 2, 2 at respective ends thereof, at which cabs 4, 4 are arranged. Power plant 8 is mounted on machine frame 3 to provide power to the operating tools of the machine and to the drive for moving the machine in an operating direction indicated by arrow 9. Conventional tamping unit 10 is vertically adjustably mounted on the machine frame and comprises reciprocable vibratory tamping tools 11 for immersion in the ballast for tamping ballast under ties 6. Conventional track lifting and lining unit 12 is mounted on machine frame 3 and comprises lifting drives 13 and lining drives 14 linking the track lifting and lining unit to the machine frame. As shown in FIG. 2, track lifting and lining unit 12 is supported by flanged rollers 19 on rails 5 and comprises lifting tools 20 consisting of vertically and transversely adjustable hooks 21 for engaging the rails of main track 7 and laterally adjustable lifting rollers 22 which are pivotal into subtending engagement with the rail heads of rails 5 while lifting hooks 20 are designed to engage either the bases or heads of rails 5.

Ballast tamping machine 1 further comprises auxiliary track lifting device 15 associated with track lifting and lining unit 12 for engaging rail 23 of branch track 24 which is connected to main track 7 by long ties 6 in the track switch section. Operator's cab 16 housing control panel 17 for operating the leveling, lining and tamping tools of the machine in conjunction with reference system 18 in a conventional manner is mounted above the auxiliary track lifting device.

Figure 3:
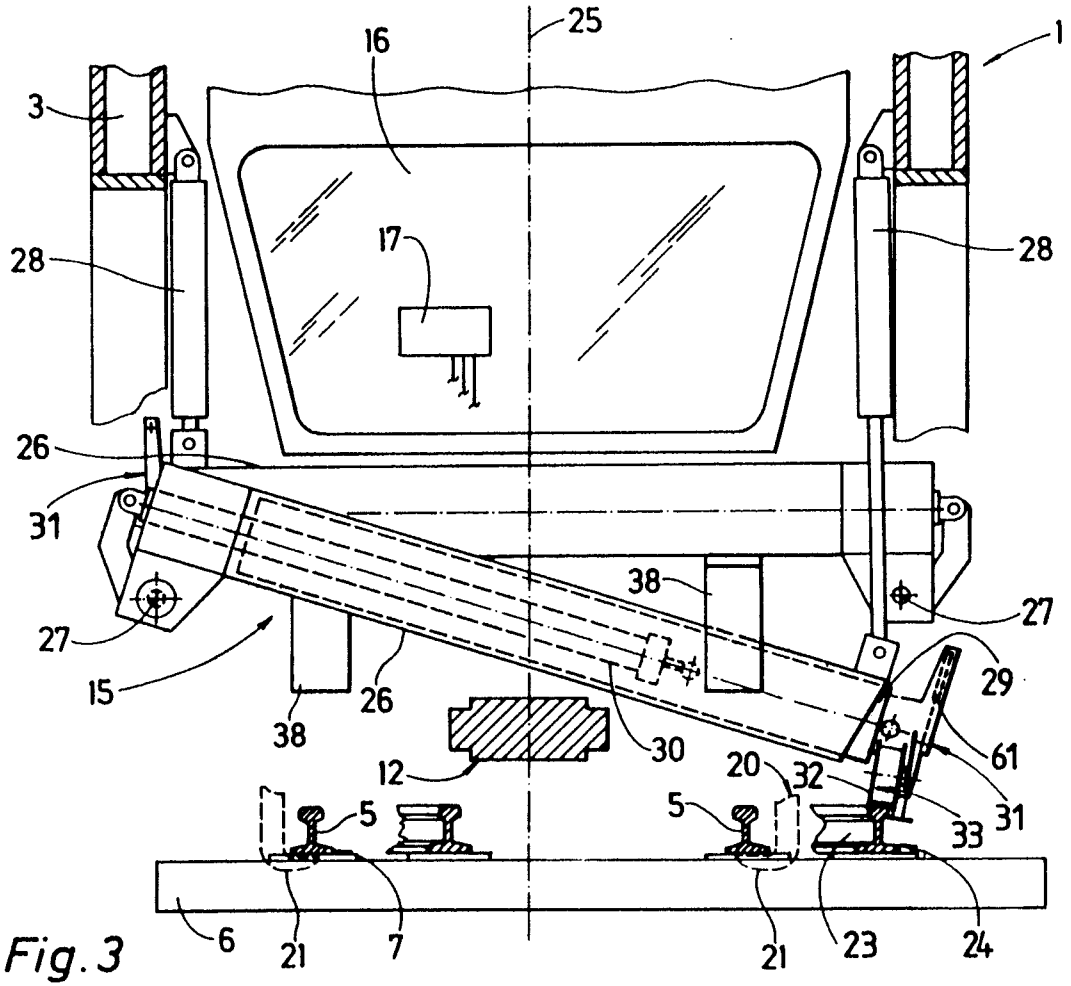
FIG. 3 is an end view, partly in section, taken in the direction of arrow III of FIG. 2, showing the auxiliary track lifting devices.

As best shown in FIGS. 2 and 3, the illustrated machine has two like auxiliary track lifting devices 15 arranged one behind the other in the longitudinal direction of elongated machine frame 3 and turned 180° with respect to vertical plane of symmetry 25 of machine 1 extending in the longitudinal direction of the machine frame. Each auxiliary track lifting device 15 comprises a carrier frame 26 extending perpendicularly to the longitudinal direction of machine frame 3 and having a free end, the carrier frames extending parallel to each other and an end opposite to the free carrier frame end of each carrier frame being pivoted to a respective side of machine frame 3 for pivoting about axis 27 extending in the longitudinal direction of the machine frame. Tool 31 for gripping branch, track rail 23 is mounted on the free carrier frame end. Auxiliary lifting drive means 28, 28 links each carrier frame to the machine frame, and displacement drive 30 is connected to branch track rail gripping tool 31 on carrier frame 26 for adjusting the tool relative to machine frame 3. In accordance with this invention, part 33 for contacting and resting on branch track rail 23 is mounted adjacent branch track rail gripping tool 31.

As illustrated in FIG. 3, each carrier frame 26 is pivoted to a side of machine frame 3 remote from branch rail gripping tool 31 for pivoting about axis 27 and the auxiliary lifting drive means comprises a hydraulically operated lifting drive 28 connecting the free carrier frame end opposite pivoting axis 27 to the machine frame. The carrier frame is tube-shaped and extends in a longitudinal direction, branch rail gripping tool 31 is mounted in tube-shaped carrier frame 26 for displacement in the longitudinal direction thereof, and displacement drive 30 is affixed to the tube-shaped carrier frame and connected to the branch rail gripping tool. The branch rail gripping tool comprises gliding part 29 extending into the interior of the tube-shaped carrier frame. Part 33 is connected to gliding part 29 for displacement therewith so that branch rail gripping tool 31 and part 33 for contacting and resting on the branch rail are displaced together.

Figure 4:
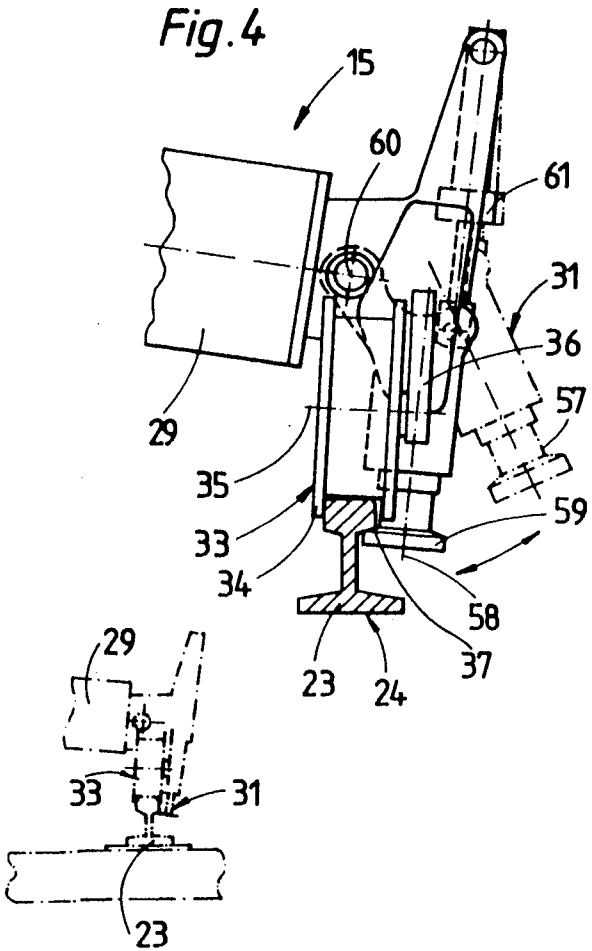
FIG. 4 is an enlarged, fragmentary end view showing the branch rail gripping tool in detail.

FIG. 4 illustrates gripping tool 31 and part 33 in detail, showing the gripping tool in engagement with branch rail 23 in full lines while its inoperative position is illustrated in phantom lines. Illustrated part 33 for contacting and resting on branch rail 23 is a double-flanged wheel 34 running on the branch rail while rotating about axis 35 extending perpendicularly to the longitudinal direction of machine frame 3 and mounted on the end of gliding part 29 by support bracket 36. The branch track rail gripping tool is a lifting roller 57 comprising mushroom-shaped element 59 rotatable about axis 58 for subtending the branch track rail head (see full lines in FIG. 4) and engaging underside 37 of the rail head. Hydraulic drive 61 links lifting roller 57 to gliding part 29 for pivoting the lifting roller about axis 60 extending in the longitudinal direction of the machine frame between its operative and inoperative positions respectively shown in full and phantom lines, the pivoting drive connecting the lifting roller to the carrier frame end adjacent part 33 for contacting and resting on the branch track rail.

Each free carrier frame end is arranged between two parallel guide plates 38, 38 extending perpendicularly to the longitudinal direction of machine frame 3. The guide plates are affixed to the underside of machine frame 3 and guide carrier frame 26 when it is pivoted about axis 27 for operation of the auxiliary lifting device. When branch rail gripping tools 31 are fully at rest, they are retracted within the outer profile of machine 1 (as can be seen at the left of FIG. 3 for the inoperative auxiliary lifting device).

Figure 5:
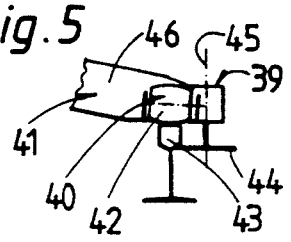
FIGS. 5, 6 and 7 are highly schematic fragmentary views of different embodiments of the branch rail gripping tool and the part contacting and resting on the branch rail.
Figure 6:
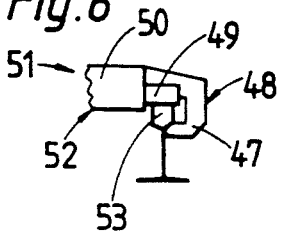
Figure 7:
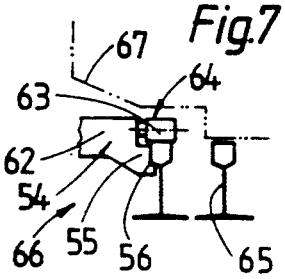

FIGS. 5 to 7 schematically illustrate different embodiments of branch rail gripping tools and associated parts for contacting and resting on the gripped branch rail. In the embodiment shown in FIG. 5, auxiliary lifting device 41 has a branch rail gripping tool 39 and part 40 for contacting and resting on branch rail 43. Part 40 is a simple roller 42 contacting and resting on the branch track rail and having an axis extending perpendicularly to the longitudinal direction of the machine frame. Gripping tool 39 is a lifting roller 44 rotatable about a substantially vertical axis 45 and fixedly mounted at the free end of the auxiliary lifting device. Tight engagement of rotating lifting roller 44 with the head of branch rail 43 is maintained by constantly operating the displacement drive (not shown) connected to gliding part 46 on which lifting roller 44 is mounted to pull the lifting roller against the rail while roller 42 runs thereon.

The embodiment of FIG. 6 is particularly simple. Auxiliary lifting device 51 has carrier frame 52 and hook 47 forming gripping tool 48 for branch rail 53 as well as part 49 contacting and resting on the branch rail are rigidly mounted on gliding part 50 displaceably arranged on the carrier frame. Auxiliary lifting device 51 cannot be used in a continuous operation but must be engaged with the branch rail before each lifting operation.

Contrary to the hereinabove described embodiments, auxiliary lifting device 66 shown in FIG. 7 has a rail gripping hook 55 adapted to engage the gage side of the rail of branch track 65 by subtending underside 56 of the rail head. Hook 55 is rigidly connected to gliding part 62 for displacement therewith, and part 64 for contacting and resting on the branch rail is a roller 63 rotatable about a substantially horizontal axis. This embodiment has the advantage that the distance of the upper edge of gliding part 62 from the running surface of the branch rail may be very small, thus reducing the possible interference of auxiliary lifting device 66 with profile 67 of branch track 65 (shown in phantom lines) to a minimum. Therefore, the operation of auxiliary lifting device 66 does not interfere, or barely interferes, with operations on the branch track.

Ballast tamping machine 1 is operated in the following manner:

An operator in cab 16 uses control panel 17 to operate the tamping, lifting and lining tools of the machine. Rails 5 of main track 7 are leveled and/or lined by actuating lifting and/or lining drives 13, 14 under the control of reference system 18 while gripping hooks 21 (see broken lines in FIG. 3) and/or lifting rollers 22 engage the main track rails. In a track switch, where long and heavy ties 6 connect a laterally adjacent branch track 24 to main track 7, carrier frame 26 of auxiliary lifting device 15 is lowered by lifting drive 28 while displacement drive 30 is actuated until part 33 contacts and rests on branch rail 23, as shown in FIG. 3. During this initial operation, lifting roller 57 of gripping tool 31 is pivoted upwardly and held in the position shown in phantom lines in FIG. 4. As soon as part 33 is in secure contact with the branch rail, drive 61 is actuated to pivot lifting roller 57 into tight engagement with branch rail 23 (full-line position in FIG. 4) so that the lifting roller subtends underside 37 of the rail head. Auxiliary lifting device 15 is now tightly connected to the branch rail and this connection can be maintained over any desired distance since double-flanged wheel 34 can follow rail 23 branching off main track 7 without problems while machine 1 continues to advance on the main track and no pressure is applied to hydraulic displacement drive 30 (see more remote branch rail position indicated in phantom lines in FIG. 3). Therefore, such an auxiliary lifting device arrangement can be used with continuous action ballast tamping machines in which machine frame 3 does not advance intermittently from tie to tie but advances continuously along the track while leveling and/or lining the same and tamping the leveled and/or lined track while the lifting and lining tools remain engaged with the track rails. During the operation of the auxiliary lifting device, lifting drive 28 is actuated synchronously with lifting drives 13 of unit 12 so that branch track 24 is leveled together with main track 7.

What is claimed is:

1. A ballast tamping machine for leveling, lining and tamping a track switch comprising a main track and a branch track comprising a rail laterally adjacent the main track and having a rail head defining a running surface, which comprises (a) a machine frame extending in a longitudinal direction and supported on undercarriages, (b) a tamping unit vertically adjustably mounted on the machine frame and comprising (1) reciprocable vibratory tamping tools, (c) a track lifting and lining unit mounted on the machine frame and comprising (1) lifting and lining drive means, (2) a flanged roller and (3) a lifting tool, and (d) an auxiliary track lifting device associated with the track lifting and lining unit, the auxiliary track lifting device comprising (1) a carrier frame extending perpendicularly to the longitudinal direction and having a free end, (2) a tool for gripping the branch track rail mounted on the free carrier frame end, the carrier frame being pivoted to a side of the machine frame remote from the branch track rail gripping tool for pivoting about an axis extending in the longitudinal direction of the machine frame, (3) an auxiliary lifting drive means, (4) a displacement drive for adjusting the branch track rail gripping tool on the carrier frame relative to the machine frame, and (5) a part for contacting and resting on the running surface of the branch track rail head, said part being mounted adjacent the branch track rail gripping tool.

2. The ballast tamping machine of claim 1, wherein the part for contacting and resting on the branch track rail is a roller having an axis extending perpendicularly to the longitudinal direction of the machine frame.

3. The ballast tamping machine of claim 2, wherein the roller is a double-flanged wheel.

4. The ballast tamping machine of claim 1, wherein the branch track rail gripping tool is a lifting roller comprising a mushroom-shaped element rotatable about an axis for subtending the branch track rail head.

5. The ballast tamping machine of claim 4, further comprising a drive for pivoting the lifting roller about an axis extending in the longitudinal direction of the machine frame, the pivoting drive connecting the lifting roller to the carrier frame end adjacent the part for contacting and resting on the branch track rail.

6. The ballast tamping machine of claim 1, wherein the auxiliary lifting drive means comprises a lifting drive connecting the carrier frame end opposite the pivoting axis to the machine frame.

7. The ballast tamping machine of claim 1, wherein the carrier frame is tube-shaped and extends in a longitudinal direction, the branch rail gripping tool is mounted in the tube-shaped carrier frame for displacement in the longitudinal direction thereof, and the displacement drive is affixed to the tube-shaped carrier frame and connected to the branch rail gripping tool.

8. The ballast tamping machine of claim 7, wherein the branch rail gripping tool comprises a gliding part extending into the interior of the tube-shaped carrier frame.

9. The ballast tamping machine of claim 1, wherein the carrier frame end is arranged between two parallel guide plates extending perpendicularly to the longitudinal direction of the machine frame.

* * * * *